US011172766B2

(12) United States Patent
Schneider et al.

(10) Patent No.: US 11,172,766 B2
(45) Date of Patent: Nov. 16, 2021

(54) SUPPORT APPARATUS

(71) Applicant: de Werth Group AG, Zürich (CH)

(72) Inventors: Johannes Schneider, Würzburg (DE); Eckhart Dewert, Goldingen (CH)

(73) Assignee: de Werth Group AG, Zürich (CH)

( * ) Notice: Subject to any disclaimer, the term of this patent is extended or adjusted under 35 U.S.C. 154(b) by 183 days.

(21) Appl. No.: 16/135,507

(22) Filed: Sep. 19, 2018

(65) Prior Publication Data

US 2019/0090655 A1 Mar. 28, 2019

(30) Foreign Application Priority Data

Sep. 27, 2017 (DE) ..... 10 2017 122 499.8
Nov. 8, 2017 (DE) ..... 10 2017 126 092.7

(51) Int. Cl.
*A47C 31/12* (2006.01)
*A47C 23/06* (2006.01)
*A47C 19/02* (2006.01)

(52) U.S. Cl.
CPC ..... *A47C 31/123* (2013.01); *A47C 19/027* (2013.01); *A47C 23/066* (2013.01); *A47C 23/067* (2013.01)

(58) Field of Classification Search
CPC ... A47C 31/123; A47C 19/027; A47C 23/066; A47C 23/067; A47C 7/14; A47C 7/26; A47C 7/462; A47C 23/00; A47C 23/06; A47C 23/061; A47C 23/062; A47C 21/006; A61H 15/0078; A61H 2015/0014;
(Continued)

(56) References Cited

U.S. PATENT DOCUMENTS 3,628,528 A * 12/1971 Roberts ..... A61H 1/001 601/116
7,386,901 B2 6/2008 Dewert
(Continued)

FOREIGN PATENT DOCUMENTS

DE 295 09 909 U1 11/1995
DE 100 46 751 A1 5/2001
(Continued)

OTHER PUBLICATIONS

Translation of DE 10 2010 021362 from Espacenet. (Year: 2010).*

*Primary Examiner* — Valerie L Woodward
*Assistant Examiner* — Paige Kathleen Bugg
(74) *Attorney, Agent, or Firm* — Shlesinger, Arkwright & Garvey LLP

(57) ABSTRACT

A support apparatus for supporting padding of seating and/or lounging furniture that has a base body with spring elements for flat support of the padding and a loading/relief apparatus for achieving pressure loading or relief on the padding. The loading/relief apparatus acts on a spring element to achieve pressure loading or relief. The loading/relief apparatus has an electric motor in operative connection with at least one pressure element by which a pressure force is exerted or exertable on a spring element to achieve pressure loading or relief. The loading/relief apparatus has a first carriage in drive connection with an electric motor and is translationally movable in the longitudinal direction of the support apparatus. The first carriage bears at least one arm whose free end carries the pressure element for load/relief of the spring elements.

16 Claims, 7 Drawing Sheets

(58) Field of Classification Search
CPC .... A61H 2201/0142; A61H 2201/0192; A61H 2201/1223; A61H 2201/1623; A61H 2201/1664; A61H 2201/1669; A61H 2201/5002; A61H 2201/5028; A61H 2203/0456; A61H 2205/081; A61H 1/001; A61H 1/005; A61H 1/006; A61H 1/008; A61H 2201/0138–0149; A61H 2201/1215; A61G 7/0573
USPC ..... 601/26
See application file for complete search history.

(56) References Cited

U.S. PATENT DOCUMENTS

| | | | | |
|---|---|---|---|---|
| 9,877,589 | B2 | 1/2018 | Dewert | |
| 2003/0052238 | A1 | 3/2003 | Schneider et al. | |
| 2004/0020316 | A1 | 2/2004 | Dewert | |
| 2008/0121852 | A1 | 5/2008 | Koch | |
| 2010/0030121 | A1* | 2/2010 | Fu | A61H 15/0078 601/99 |
| 2013/0239324 | A1* | 9/2013 | Mossbeck | A47C 20/04 5/254 |
| 2014/0188018 | A1* | 7/2014 | Vaughn | A61H 7/007 601/90 |
| 2015/0074908 | A1 | 3/2015 | Dewert | |
| 2016/0015583 | A1* | 1/2016 | Dewert | A61G 7/015 5/616 |
| 2016/0157623 | A1 | 6/2016 | Dewert | |
| 2017/0332798 | A1 | 11/2017 | Dewert | |

FOREIGN PATENT DOCUMENTS

| | | | | |
|---|---|---|---|---|
| DE | 100 46 750 | C1 | 4/2002 | |
| DE | 20 2005 009 180 | U1 | 10/2005 | |
| DE | 20 2004 020 384 | U1 | 12/2005 | |
| DE | 10 2008 031 043 | A1 | 12/2009 | |
| DE | 10 2010 021 362 | A1 | 2/2012 | |
| DE | 102010021362 | A1 * | 2/2012 | A47C 23/063 |
| WO | WO 2012/052972 | A1 | 4/2012 | |
| WO | WO 2016/156247 | A1 | 10/2016 | |

* cited by examiner

SUPPORT APPARATUS

CROSS-REFERENCE TO RELATED APPLICATIONS

This application claims the priority of German Application No. 10 2017 122 499.8, filed Sep. 27, 2017, and this application claims the priority of German Application No. 10 2017 126 092.7, filed Nov. 8, 2017, and each of which is incorporated herein by reference.

FIELD OF THE INVENTION

The present invention relates to a support apparatus for supporting padding of seating and/or lounging furniture, in particular a mattress of a bed,

BACKGROUND OF THE INVENTION

Support apparatuses of this type are generally known, and may be designed as a slatted frame, for example. The support apparatus has a base body with preferably at least two support parts that are adjustable relative to one another, and on which spring elements are situated which support the padding when the support apparatus is being used. An electric motor-driven adjustment apparatus may be provided for adjusting the support parts relative to one another A support apparatus is known from DE 10 2010 021 362 A1, in which a loading/relief apparatus for achieving pressure loading or relief on the padding is provided. The loading/relief apparatus is situated beneath the base body of the support apparatus.

Similar support apparatuses are also known from DE 10 2008 031 043 A1, DE 20 2005 009 180 U1, WO 2012/052972 A1, and DE 29509909 U1.

A support apparatus of the type in question for supporting padding of seating and/or lounging furniture is known from WO 2016/156247, and has a base body with spring elements for flat support of the padding, and at least one loading/relief apparatus for achieving pressure loading and/or relief on the padding, wherein the loading/relief apparatus acts on at least one spring element to achieve pressure loading and/or relief. The loading/relief apparatus has at least one electric motor that is in operative connection with at least one pressure element, by means of which a pressure force is exerted or exertable on at least one spring element to achieve pressure loading and/or relief.

OBJECTS AND SUMMARY OF THE INVENTION

An object of the invention is to provide a support apparatus of the type set forth herein which is robust and has a simple design.

This object is achieved by the invention set forth herein.

According to the invention, the loading/relief apparatus has at least one first carriage that is in drive connection with an electric motor and that is translationally movable in the longitudinal direction of the support apparatus, wherein the carriage bears at least one arm whose free end carries the pressure element for load/relief of the spring elements.

According to the invention, the pressure element or the pressure elements is/are situated on at least one carriage that is translationally movable in the longitudinal direction of the support apparatus. Depending on the particular position of the carriage in the longitudinal direction of the support apparatus, different spring elements, and therefore different areas, are acted on with pressure in the longitudinal direction of the support apparatus, so that a massage effect, for example, may be achieved. By appropriate movement of the carriage, for example a rolling massage effect may be achieved which is generally perceived as pleasant.

The support apparatus according to the invention thus opens up various options, for example for achieving a massage effect.

In principle, it is sufficient to provide a single pressure element that acts on the spring elements, for example in the longitudinal center plane of the support apparatus. To achieve a more uniform pressure effect transverse to the longitudinal direction, one advantageous refinement of the invention provides that the first carriage bears at least two arms, each carrying a pressure element, wherein the pressure elements are spaced apart from one another transversely with respect to the longitudinal direction of the support apparatus.

Another advantageous refinement of the invention provides that the spring elements are elastic slats that are connected to one another via at least one flexible band, wherein at least one pressure element rests against the band for load/relief of the slats via the band. This results in a particularly simple design of the loading/relief apparatus.

The shape and configuration of the pressure element are selectable within wide limits, depending on the particular requirements. One advantageous refinement of the invention provides that at least one pressure element is designed as a wheel or roller.

According to another advantageous refinement of the invention, a first electric motor-driven linear drive is associated with the first carriage for moving the carriage in the longitudinal direction of the support apparatus. Such linear drives are available as relatively simple and inexpensive standard components.

One extremely advantageous refinement of the invention provides that the or each pressure element is adjustable relative to the spring elements in the direction toward the support plane and in the direction away from the support plane, and that an electric motor-driven adjustment drive is associated with the or each pressure element. It is thus possible not only to adjust the position at which loading and relief, for example for achieving a massage effect, are carried out, but also to adjust the intensity of the pressure load by adjusting the pressure element to a greater or lesser extent relative to the support plane. In this way, for example the intensity of a massage effect may be adapted to the circumstances of the particular user.

In the embodiment mentioned above, the adjustment of the pressure element relative to the support plane may be achieved in various ways. In terms of a particularly simple and robust design, one advantageous refinement provides that the or each pressure element is situated on a free end of a pivot lever, and that a pivot drive as an adjustment drive is associated with the pivot lever in order to adjust the pressure element relative to the spring elements.

One advantageous refinement of the embodiment mentioned above provides that the or each pivot drive has a second electric motor-driven linear drive.

One refinement of the embodiments with the linear drives provides that at least one electric motor-driven linear drive has a spindle drive. Such spindle drives are available as relatively simple and inexpensive standard modules, and are particularly robust.

Another refinement of the embodiment with the pivot lever or the pivot levers provides that the or each pivot lever is rotatably fixedly connected to a pivot shaft that is pivotably supported on the first carriage, wherein the pivot shaft is in pivot drive connection with the second electric motor-driven linear drive. In this embodiment, the pivot drive acts on the pivot shaft.

When a linear drive is used as a pivot drive, the conversion of the linear movement of the output drive member of the linear drive into a pivot movement may be achieved in various ways. In this regard, one embodiment with a particularly simple design provides that a first end of a connecting bracket at a first articulation point is articulatedly connected to a linearly movable output drive member of the second linear drive, while a second end of the connecting bracket at a second articulation point is connected to the pivot shaft, eccentrically with respect to its pivot axis, in such a way that the pivot shaft pivots about its pivot axis during a linear movement of the output drive member.

According to the invention, in principle it is sufficient when the support apparatus has a single loading/relief apparatus. Load or relief at different locations on the support apparatus may then be achieved by appropriately positioning the carriage. To achieve load or relief at the same time in at least two areas that are spaced apart from one another in the longitudinal direction of the support apparatus, one advantageous refinement provides that at least two loading/relief apparatuses are provided which are spaced apart from one another in the longitudinal direction of the support apparatus in order for different areas to be acted on in the longitudinal direction of the support apparatus. This further increases comfort for a user of the support apparatus, for example due to the fact that a massage effect may be achieved in different areas of the support apparatus at the same time.

Another advantageous refinement provides a control apparatus for controlling the electric motor or the electric motors. The actuation of the control apparatus may take place, for example, via remote control or a manual switch in a wired or wireless manner.

One extremely advantageous refinement of the invention provides that the control apparatus controls the electric motor or the electric motors in such a way that the pressure element or the pressure elements act(s) sequentially in time on at least two spring elements situated in succession in the longitudinal direction of the support apparatus. Practically any load or massage pattern may thus be implemented by appropriate programming of the control apparatus.

In terms of a simple and uncomplicated design, another advantageous refinement of the invention provides that the or each pressure element loosely acts on the or each associated spring element.

The spring elements may be designed as elastic slats, for example, in various ways. In this regard, another advantageous refinement provides that the spring elements are bed frames. Such bed frames are available as relatively simple and inexpensive standard components, and provide a high level of suspension comfort.

According to the invention, it is sufficient in principle when the base body of the support apparatus has a single support part that defines an essentially horizontal support plane. To further increase the comfort for a user of the support apparatus, one advantageous refinement provides that the support apparatus has at least two support parts that are pivotably adjustable relative to one another. The support apparatus thus provides adjustment options, for example between a sitting position and a lying position, as is generally known for slatted frames.

To further increase the comfort, one refinement of the above-mentioned embodiment provides at least one electric motor-driven adjustment apparatus, situated on the support apparatus, for adjusting the inclination and/or the height of at least one support part.

Another advantageous refinement of the invention provides that the loading/relief apparatus together with the support apparatus and the padding is accommodated in a shared casing.

According to another advantageous refinement of the invention, the loading/relief apparatus is situated within the profile height of the base body of the support apparatus. According to the invention, an arrangement within the profile height of the base body of the support apparatus is understood to mean that the loading/relief apparatus does not protrude beyond the base body in the side view, i.e., in the vertical direction.

Another extremely advantageous refinement of the invention provides sensor means, associated with the support plane, for sensing the weight of a person resting on the support apparatus, wherein the sensor means are in data transmission connection with the control apparatus, and the control apparatus is designed and programmed in such a way that the pressure force exerted by at least one pressure element is set or settable as a function of the sensed weight. In this way, loading with a relatively small pressure force for a person having a relatively low body weight, and loading with a relatively large pressure force for a person having a relatively high body weight, may take place so that the massage effect is adapted to the body weight of the particular user. A massage function that is perceived as pleasant in each case for users having different body weights may be achieved in this way.

The invention is explained in greater detail below with reference to the appended drawings, in which one embodiment of a support apparatus according to the invention is illustrated. All features that are described, illustrated in the drawings, and claimed in the patent claims, alone or in any suitable combination, constitute the subject matter of the invention, regardless of their description or illustration in the drawings, and regardless of their recapitulation in the patent claims or back-reference.

Relative terms such as left, right, up, and down are for convenience only and are not intended to be limiting.

DETAILED DESCRIPTION OF THE INVENTION

Figure 1:
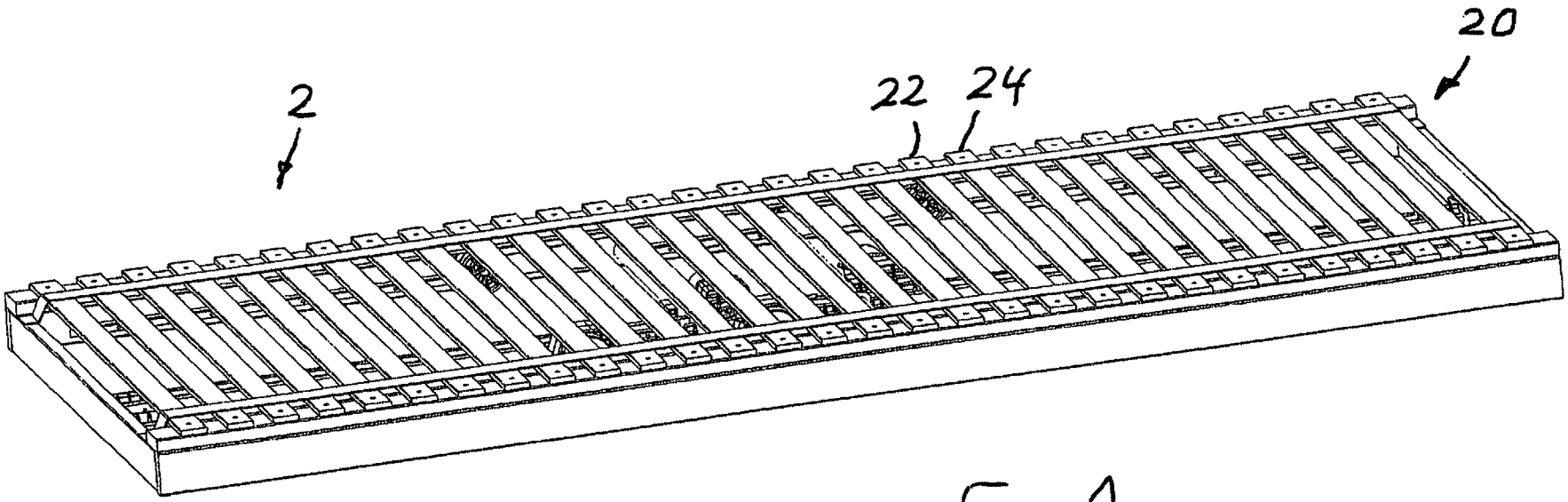
FIG. 1 shows a schematic perspective view of one exemplary embodiment of a support apparatus according to the invention.

FIG. 1 illustrates one exemplary embodiment of a support apparatus 2 according to the invention, having a base body 20 which in this exemplary embodiment is designed as a slatted frame and has a plurality of spring elements that are formed by elastic slats. Only two slats are provided with reference numerals 22, 24 in FIG. 1. The top side of the slats 22, 24 defines a support plane on which padding, for example a mattress, is supported when the support apparatus is being used.

To provide a massage function, an electromechanical loading/relief apparatus is provided, as explained in greater detail below.

Figure 2:
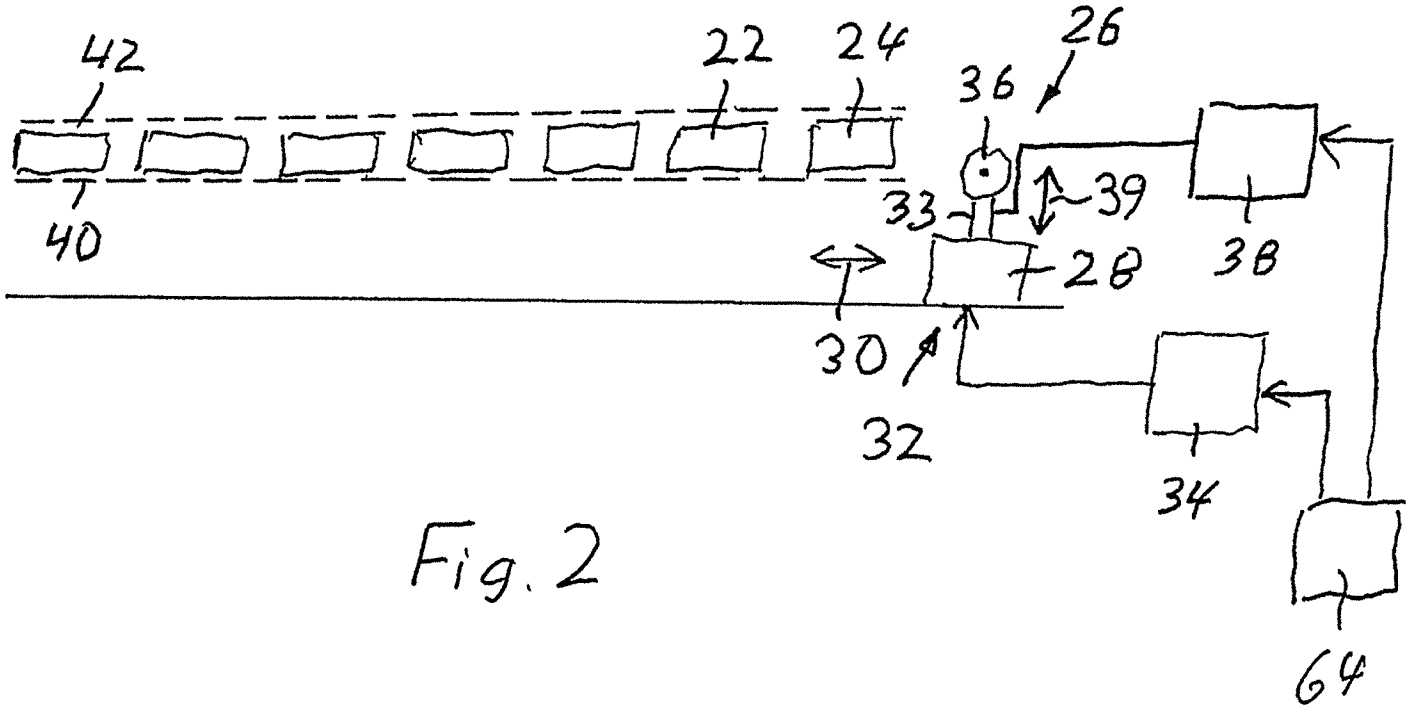
FIG. 2 shows a schematic diagram for explaining the functional principle of a loading/relief apparatus of the support apparatus according to FIG. 2.

FIG. 2 shows a schematic diagram of an electromechanical loading/relief apparatus 26.

The loading/relief apparatus 26 has a first carriage 28 that is translationally movable in the longitudinal direction of the support apparatus 2, as symbolized by a double arrow 30 in FIG. 2. The first carriage 28 is part of a first linear drive 32. The first carriage 28 is in drive connection with a first electric motor 34, and bears an arm 33 whose free end carries a pressure element 36 for loading or relief of the slats 22, 24.

In this exemplary embodiment the pressure element 36 is designed as a wheel or roller.

The pressure element 36 is adjustable relative to a support plane that is defined by the slats 22, 24. An adjustment drive 38 is designed and configured for adjusting the pressure element 36 relative to the support plane, as symbolized by a double arrow 39 in FIG. 2. An associated adjustment drive 38 that has a second electric motor is explained in greater detail below with reference to FIGS. 6 and 7.

The slats 22, 24 are held between flexible bands, symbolized by dashed lines 40, 42 in FIG. 2.

When the support apparatus 2 is used, for achieving a massage effect the first carriage 28 of the first linear drive is moved along the associated linear axis, to the left in FIG. 2.

The pressure element 36 is adjustable relative to the slats 22, 24 by means of the adjustment drive 38 in order to achieve loading/relief on the slats and thus to implement a massage function.

Figure 3:
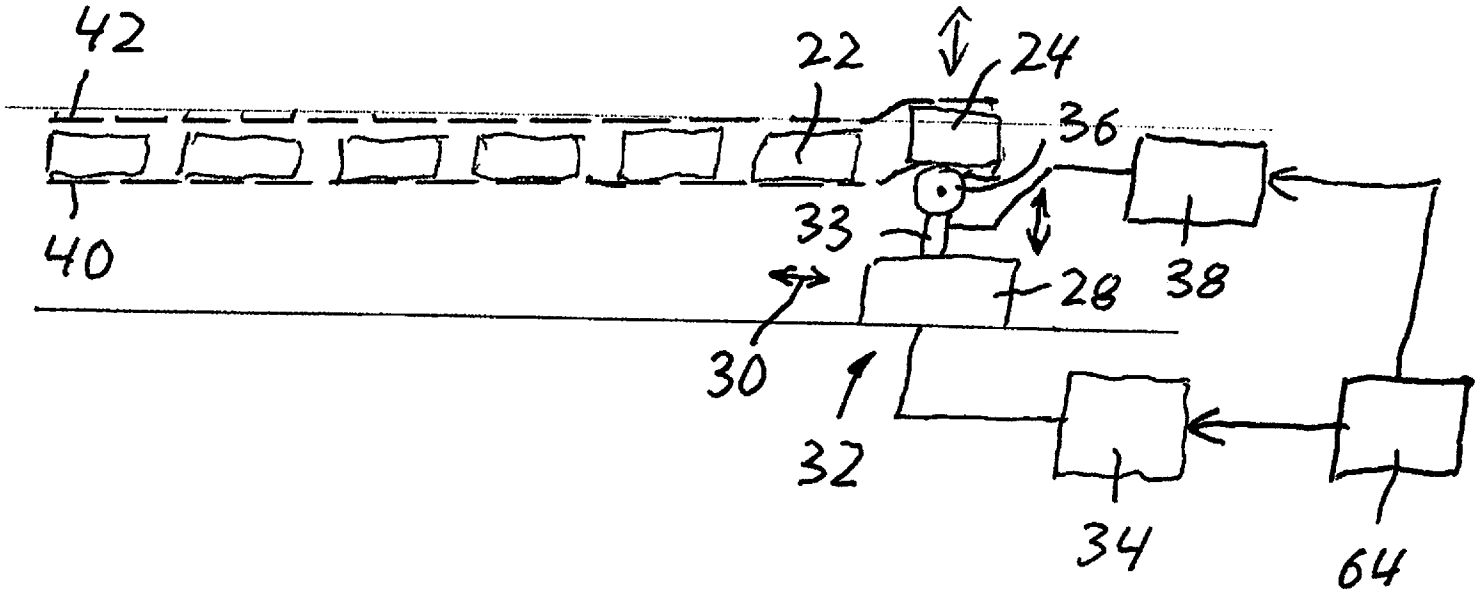
FIG. 3 shows another schematic diagram in the same illustration as FIG. 2.

FIG. 3 shows the interaction between the pressure element 36 and the slat 24, wherein the pressure element 36 acts with pressure on the slat 24 so that the latter is deflected in such a way that it protrudes beyond the support plane. As is apparent from FIG. 3, the pressure element 36 rests against the side of the band 40 facing away from the slats 22, 24.

As is apparent from FIGS. 2 and 3, during a linear movement of the first carriage 28 the successive slats 22, 24 in the longitudinal direction of the support apparatus 2 are acted on, one after the other, to achieve a "rolling" massage effect.

One exemplary embodiment for practical implementation of the basic principle illustrated in FIGS. 2 and 3 is explained in greater detail below with reference to FIGS. 4 through 7.

Figure 4:
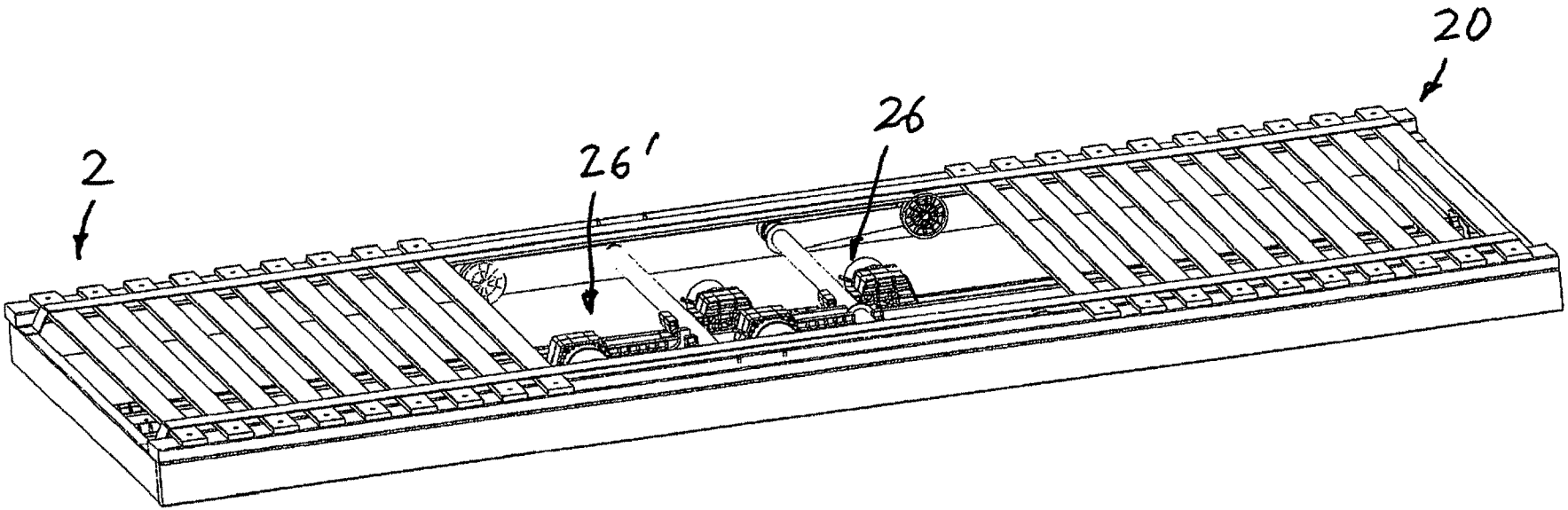
FIG. 4 shows the support apparatus according to FIG. 1, with spring elements in the form of elastic slats being omitted in an area of the support apparatus for reasons of illustration.

The support apparatus 2 is illustrated in FIG. 4, with some slats omitted for clarification of details of the electromechanical loading/relief apparatus 26.

In this exemplary embodiment, in addition to the loading/relief apparatus 26 a further loading/relief apparatus 26' is provided. The loading/relief apparatuses 26, 26' are spaced apart from one another in the longitudinal direction of the support apparatus 2 to allow a massage effect in different areas in the longitudinal direction of the support apparatus 2.

Both loading/relief apparatuses 26, 26' have the same design. Therefore, only the loading/relief apparatus 26 is explained in greater detail below. In FIGS. 4 through 7, for reasons of illustration only the loading/relief apparatus 26 is illustrated, with omission of the loading/relief apparatus 26'.

Figure 5:
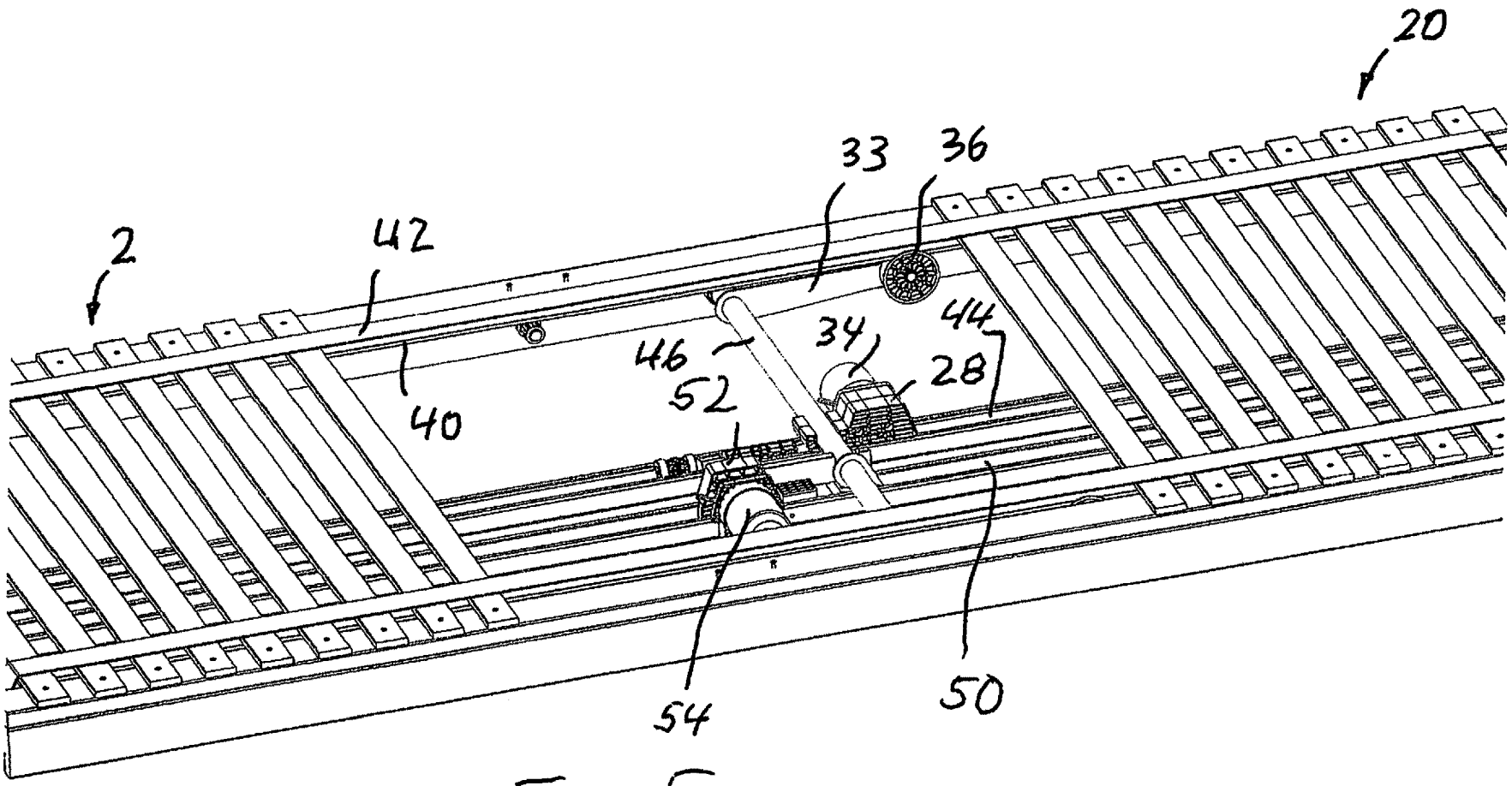
FIG. 5 shows a detail from FIG. 4, in the same illustration as FIG. 4 but in enlarged scale, with further components of the support apparatus being omitted for reasons of illustration.

As illustrated in FIG. 5, the loading/relief apparatus 26 has the first carriage 28, which is part of the first linear drive and is movable along a linear axis in the longitudinal direction of the support apparatus 2. The linear axis is defined by a first linear guide 44 that extends in the longitudinal direction of the support apparatus 2.

The first carriage 28 is in drive connection with the first electric motor 34, the first carriage 28 bearing the arm 33 (see FIGS. 5 and 6), whose free end carries the pressure element 36 for load/relief of the slats 22, 24. In this exemplary embodiment, the pressure element 36 is designed as a wheel or roller that is supported so as to be rotatable relative to the arm 33 and that rests against the side of the band 40 facing away from the slats 22, 24 (see in particular FIG. 6).

In the illustrated exemplary embodiment, the first carriage 28 bears two arms, namely, the arm 33 and another arm 33', the arms 33, 33' carrying a pressure element 36 and 36', respectively. The pressure elements 36, 36' are spaced apart from one another, transversely with respect to the longitudinal direction of the support apparatus 2, as is apparent in particular from FIG. 6.

The pressure elements 36, 36' are adjustable relative to the support plane defined by the slats 22, 24, wherein the adjustment drive 38 is provided for adjusting the pressure elements 36, 36' relative to the support plane.

Figure 6:
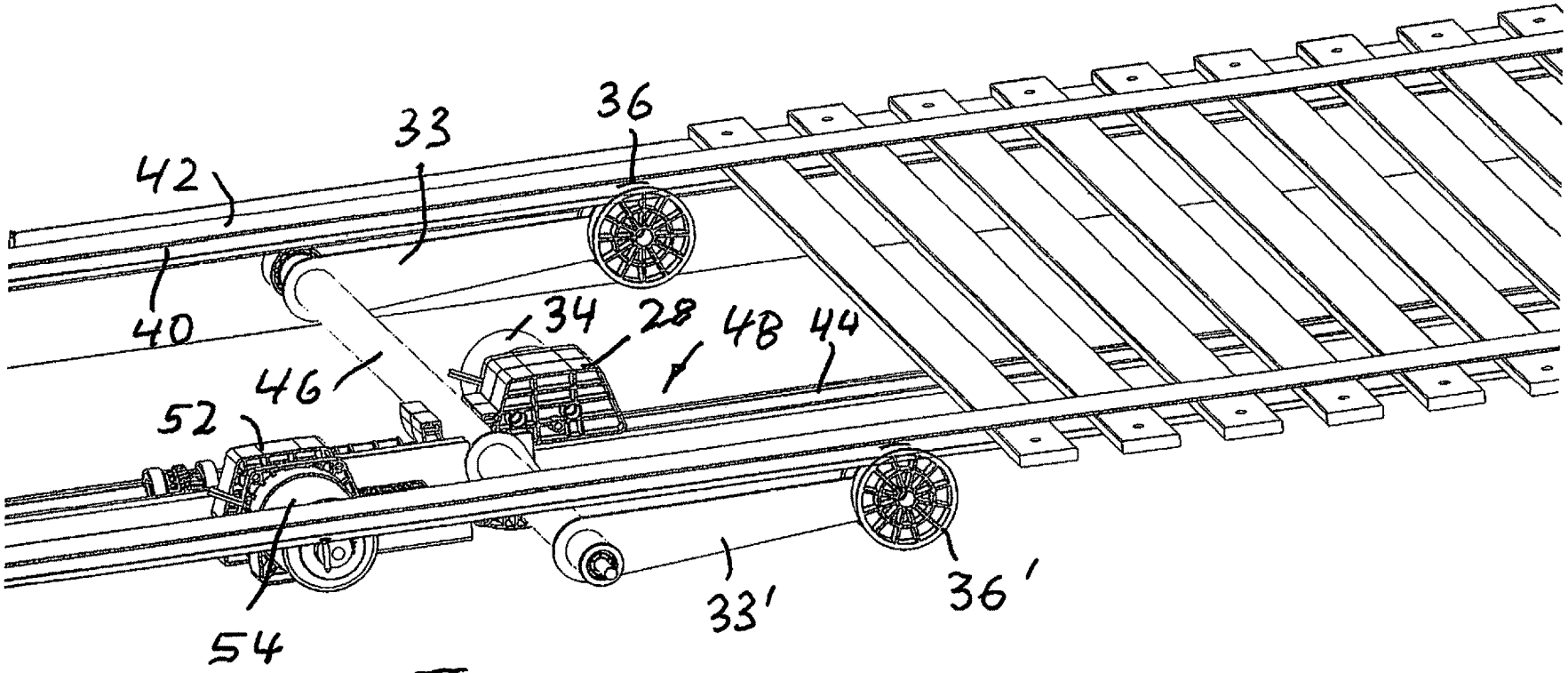
FIG. 6 shows a perspective view of a loading/relief apparatus of the support apparatus according to FIG. 1.

A pivot shaft 46 to which the arms 33, 33' are rotatably fixedly connected is pivotably supported on the first carriage 28 (see FIG. 6). The adjustment drive 38 is designed to pivot the pivot shaft 46 about its pivot axis in order to adjust the pressure elements 36, 36' relative to the slats 22, 24 by pivoting the arms 33, 33'. Accordingly, the arms 33, 33' have the function of pivot levers.

The first linear drive has a first spindle drive 48 (see FIG. 6) for moving the first carriage 28 along the first linear guide 44. The first spindle drive 48 has a first threaded spindle that extends in the longitudinal direction of the first linear guide 44 and that is rotatably fixedly supported. A first spindle nut is mounted on the first threaded spindle, and via a worm gear is in rotary drive connection with the output shaft of the first electric motor 34. The first spindle nut together with the worm gear and the output shaft is accommodated in the first carriage 28, which has a housing-like design.

The first spindle nut rotates when the output shaft of the first electric motor 34 rotates. As a result, the first carriage 28 moves along the first linear guide 44 in one direction or the other, corresponding to the direction of rotation of the spindle nut, as the result of which the first carriage 28 together with the pressure elements 36, 36' is positioned in the longitudinal direction of the first linear guide, so that the slats 22, 24 are acted on by the pressure elements 36, 36' at the appropriate location for load/relief of the slats 22, 24 in question.

A second linear guide 50 is provided in parallel to the first linear guide 44 (see FIG. 5). A second carriage 52 is guided on the second linear guide 50 in the longitudinal direction of the support apparatus 2.

The pivot shaft 46 is rotatably or pivotably connected to the second carriage 52. The second carriage 52 is thus nondisplaceably connected to the first carriage 28 by means of the pivot shaft. As a result, the carriages 28, 52 move synchronously when the first carriage 28 moves upon actuation of the first electric motor 34.

The adjustment drive 38 is explained in greater detail below with reference to FIG. 7.

The adjustment drive 38 has a second linear drive with a second electric motor 54 and a second spindle drive 56.

A second spindle nut 58 is rotatably fixedly situated on a second threaded spindle of the second spindle drive 56. The second spindle nut forms the output drive member of the second spindle drive 56. When the second electric motor 54 is actuated, the second threaded spindle rotates, so that the second spindle nut 58 moves in the axial direction of the second threaded spindle in one direction or the other, corresponding to the direction of rotation of the second threaded spindle.

Figure 7:
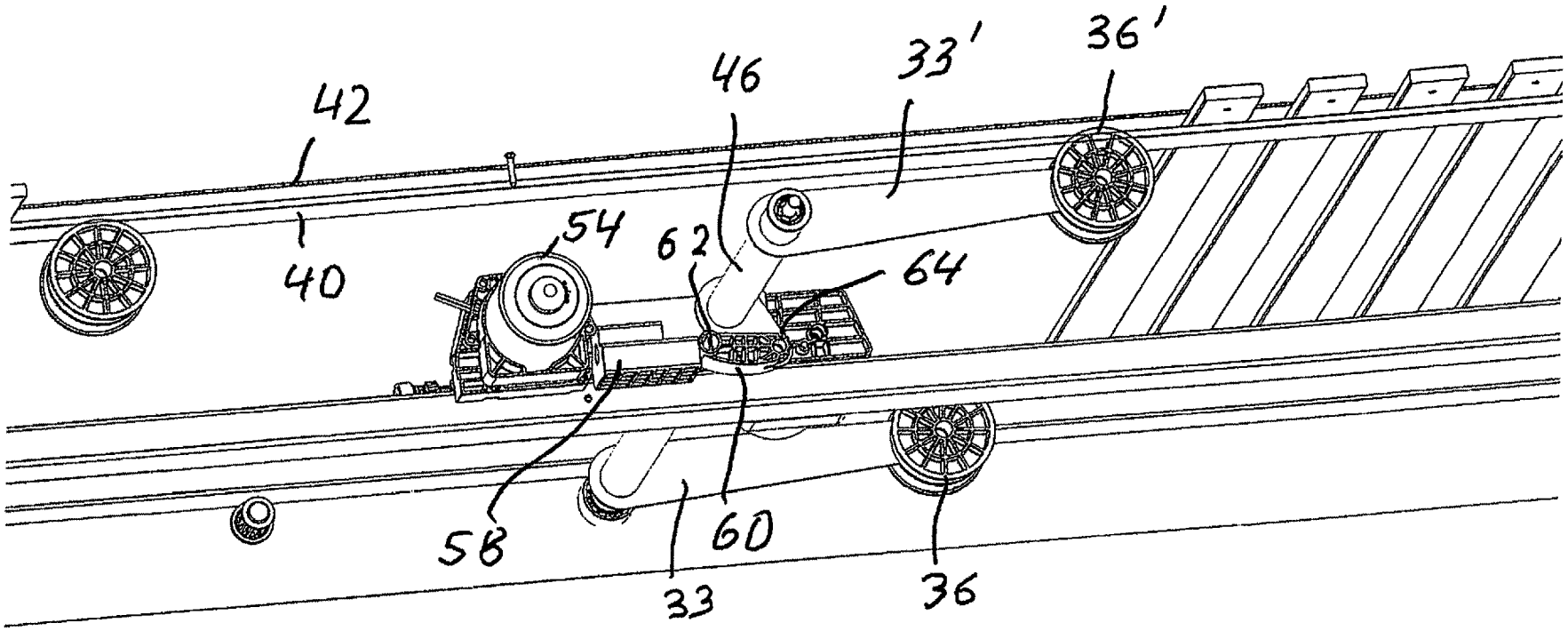
FIG. 7 shows another perspective view of the loading/relief apparatus according to FIG. 6.

As illustrated in FIG. 7, a connecting bracket 60 is provided for rotation or pivoting of the pivot shaft 46 about its pivot axis during a linear movement of the second spindle nut 58. A first end of the connecting bracket 60 at a first articulation point 62 is articulatedly connected to the second spindle nut, while a second end of the connecting bracket 60 at a second articulation point 64 is connected to the pivot shaft 46, in particular eccentrically connected to the pivot axis thereof, in such a way that the pivot shaft 46 pivots during a linear movement of the second spindle nut 58.

A control apparatus 64 (see FIG. 2) is provided for controlling the electric motors 34, 54.

When the first electric motor 34 is actuated, the carriages 28, 52 are positioned relative to the slats 22, 24 along the linear guides 44, 50 in order to act on the slats 22, 24 in the particular area.

When the second electric motor 54 is actuated, the pivot shaft 46 pivots, so that the pressure elements 36, 36' act with a pressure load on the particular slats. The intensity of the resulting massage effect is controllable by controlling the pivot angle.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

The invention claimed is:

1. A support apparatus for supporting a padding of seating and/or lounging furniture, the support apparatus comprising:

a) a base body with a plurality of spring elements for flat support of the padding;

b) at least one loading/relief apparatus for achieving pressure loading or relief on the padding, and the loading/relief apparatus acts on at least one of the plurality of spring elements to achieve pressure loading or relief;

c) the loading/relief apparatus has a plurality of electric-motor driven linear drives in operative connection with a plurality of pressure elements, by which a pressure force is exerted or excitable on at least one spring element of the plurality of spring elements to achieve pressure loading or relief;

d) the loading/relief apparatus has a first carriage that is in drive connection with a first electric-motor driven linear drive and is translationally movable in a longitudinal direction of the support apparatus, and the first carriage bears at least one arm whose free end carries the plurality of pressure elements for loading/relief of the plurality of spring elements;

e) the plurality of spring elements are elastic slats that are connected to one another via at least one flexible band, and one of the plurality of pressure elements rests against the flexible band for loading/relief of the elastic slats via the flexible band;

f) the plurality of pressure elements are adjustable relative to the plurality of spring elements in a direction toward a support plane and in a direction away from the support plane, and an adjustment drive configured as a second electric motor-driven linear drive is associated with at least one of the plurality of pressure elements;

g) the at least one of the plurality of pressure elements is situated on the free end of the at least one arm, and the adjustment drive acts as a pivot drive and is associated with the arm in order to adjust the at least one of the plurality of pressure elements relative to the plurality of spring elements; and h) the loading/relief apparatus together with the support apparatus and the padding are accommodated in a shared casing.

2. The support apparatus according to claim 1, wherein:

a) the first carriage bears at least two arms, each carrying one of the plurality of pressure elements, and each of the plurality of pressure elements is spaced apart from one another transversely with respect to the longitudinal direction of the support apparatus.

3. The support apparatus according to claim 1, wherein:

a) the plurality of pressure elements are each designed as a wheel or roller.

4. The support apparatus according to claim 1, wherein:

a) at least one of the plurality of electric motor-driven linear drives has a spindle drive.

5. The support apparatus according to claim 1, wherein:

a) the at least one arm is rotatably fixedly connected to a pivot shaft that is pivotably supported on the first carriage, wherein the pivot shaft is in pivot drive connection with the second electric motor-driven linear drive.

6. The support apparatus according to claim 5, wherein:

a) a first end of a connecting bracket at a first articulation point is articulatedly connected to a linearly movable output drive member of the second electric-motor driven linear drive, while a second end of the connecting bracket at a second articulation point is connected to the pivot shaft eccentrically with respect to its pivot axis, in such a way that the pivot shaft pivots about its pivot axis during a linear movement of the output drive member.

7. The support apparatus according to claim 1, wherein:

a) at least two loading/relief apparatuses are provided which are spaced apart from one another in the longitudinal direction of the support apparatus in order for different areas to be acted on in the longitudinal direction of the support apparatus.

8. The support apparatus according to claim 1, wherein:

a) a control apparatus is provided for controlling the plurality of electric motor-driven linear drives.

9. The support apparatus according to claim 8, wherein:

a) the control apparatus controls the plurality of electric motor-driven linear drives in such a way that the plurality of pressure elements act sequentially in time on at least two of the plurality of spring elements situated in succession in the longitudinal direction of the support apparatus.

10. The support apparatus according to claim 1, wherein:

a) the plurality of spring elements comprise a bed frame.

11. The support apparatus according to claim 1, wherein:

a) the support apparatus has at least two support parts that are pivotably adjustable relative to one another.

12. The support apparatus according to claim 1, wherein:

a) at least one of the plurality of electric motor-driven linear drives is provided on the support apparatus for adjusting the inclination and/or the height of at least one support part.

13. The support apparatus according to claim 1, wherein:

a) the loading/relief apparatus is situated within a profile height of the base body of the support apparatus.

14. The support apparatus according to claim 8, wherein:

a) a sensor means, associated with the support plane, is provided for sensing the weight of a person resting on the support apparatus, wherein the sensor means is in data transmission connection with the control apparatus, and the control apparatus is designed and programmed in such a way that a pressure force exerted by each of the plurality of pressure elements is set or settable as a function of the sensed weight.

15. The support apparatus according to claim 1, wherein:

a) the padding is a mattress of a bed.

16. A support apparatus for supporting a padding of seating and/or lounging furniture, the support apparatus comprising:

a) a base body with a plurality of spring elements for flat support of the padding;

b) at least one loading/relief apparatus for achieving pressure loading or relief on the padding, and the loading/relief apparatus acts on at least one of the plurality of spring elements to achieve pressure loading or relief;

c) the loading/relief apparatus has a plurality of electric-motor driven drives in operative connection with a plurality of pressure elements, by which a pressure force is exerted or exertable on at least one spring element of the plurality of spring elements to achieve pressure loading or relief;

d) the loading/relief apparatus has a first carriage that is in drive connection with a first electric-motor driven drive, the first electric-motor driven drive is a linear drive, and is translationally movable in a longitudinal direction of the support apparatus, and the first carriage bears at least one arm whose free end carries the plurality of pressure elements for loading/relief of the plurality of spring elements;

e) the plurality of spring elements are elastic slats that are connected to one another via at least one flexible band, and one of the plurality of pressure elements rests against the flexible band for loading/relief of the elastic slats via the flexible band;

f) the plurality of pressure elements are adjustable relative to the plurality of spring elements in a direction toward a support plane and in a direction away from the support plant, and an adjustment drive configured as a second electric-motor driven drive is associated with at least one of the plurality of pressure elements;

g) the at least one of the plurality of pressure elements is situated on the free end of the at least one arm, and the adjustment drive acts as a pivot drive and is associated with the arm in order to adjust the at least one of the plurality of pressure elements relative to the plurality of spring elements; and h) the loading/relief apparatus together with the support apparatus and the padding are accommodated in a shared casing.

* * * * *